US007096526B1

(12) United States Patent
Ogan

(10) Patent No.: US 7,096,526 B1
(45) Date of Patent: Aug. 29, 2006

(54) BEACH BLANKET

(75) Inventor: Laura E Ogan, Carlsbad, CA (US)

(73) Assignee: Laura Ogan, Carlsbad, CA (US)

( * ) Notice: Subject to any disclaimer, the term of this patent is extended or adjusted under 35 U.S.C. 154(b) by 0 days.

(21) Appl. No.: 11/208,252

(22) Filed: Aug. 19, 2005

(51) Int. Cl.
*A47G 9/06* (2006.01)

(52) U.S. Cl. ..... 5/418; 5/417

(58) Field of Classification Search ..... 5/418, 5/417, 420, 419, 482
See application file for complete search history.

(56) References Cited

U.S. PATENT DOCUMENTS 5,059,463 A * 10/1991 Peters ..... 428/64.1
5,347,667 A * 9/1994 Schwarz et al. ..... 5/418
6,502,257 B1 * 1/2003 Glenn ..... 5/418
6,901,615 B1 * 6/2005 Lombardo et al. ..... 5/417

* cited by examiner

*Primary Examiner*—Alexander Grosz

(57) ABSTRACT

A beach towel made of terry cloth which is round, square and rectangular.

A round, square, or rectangular beach towel made of terry cloth has two holes—one in the middle and the second along the perimeter of the round beach towel and along any edge of the square or rectangular beach towel. Comfort provided by the beach towel when paired by a beach umbrella whose handle is planted either in the middle hole or in any hole along the perimeter or edge it shade. This kind of beach towel may be used not only in beaches but also in front and back yards, parks, playgrounds, camps, picnic areas or any place where relaxation and comfort benefit users who prefer lying down or sitting on towels rather than sitting on chairs.

1 Claim, 6 Drawing Sheets

BEACH BLANKET

FIELD OF THE INVENTION

The present invention relates to a round, rectangular or square beach towel which has one hole in the middle and one hole in any of the edges or perimeter. The diameter of each hole is three inches. The area of the round beach towel is eight feet in diameter; the rectangular beach towel has five feet in width and eight feet in length while the square beach towel has eight feet in width and eight feet in length.

BACKGROUND OF THE INVENTION

People go to the beach for relaxation. One of the usual objects that is brought to the beach for comfort is a towel. It can be a big towel that is spread on the sand and where people sit or lie on. The ordinary towel comes in many sizes and shapes. It is square, rectangular or round. The beach umbrella is almost always round. When the heat becomes uncomfortable, a beach umbrella is brought out to provide shade.

Ordinarily, comfort given by the towel and the umbrella is limited to one side and is not maximized. With a round, rectangular or square towel that has one hole in the middle and one hole in any of the edges or perimeter where the handle of the umbrella is planted in any of the two holes, shade is maximized and comfort enjoyed by whoever is seated, lying down or standing on the towel.

The beach towel is made of terry cloth for easy maintenance. Since the towel is light to carry, it can be used in any place where an umbrella's handle can be planted.

The beach towel can be used in the frontyards, backyards, parks, along rivers, beaches and lakes, at camps and anywhere where there is a need for one.

So far, there is no comparable beach towel in the market with one hole in the middle and a second hole in any of the edges or perimeter for an umbrella's handle to be planted.

The prior art cited below describes examples of attempts to provide for some or all the noted capabilities but, as shall be seen, each falls short of completely achieving these goals.

U.S. Pat. No. 4,278,719 issued to Sarnecki discloses a waterproof backed towel comprised of a backing sheet of waterproof nylon and a terrycloth cover sheet.

U.S. Pat. No. 4,794,029 issued to Tennant et al. discloses a round towel that converts into a handbag.

U.S. Pat. No. 293,060 issued to Botbol discloses a circular towel used for sunbathing.

U.S. Pat. No. 5,059,463 issued to Peters discloses a circular mat having an outer rim that is reinforced by a steel ribbon keeps its shape while laid out and also allows for ready folding and storage.

Accordingly, there exists a need for a towel that can be used with a beach umbrella. With respect to the above description of the beach towel, it is to be understood that the invention is not limited to its application in the beach but it can be used in parks, frontyards, backyards of residential houses and playgrounds. It is to be understood also that the terminology and phraseology employed herein are for the purpose of description and should not be regarded as limiting.

As such, those skilled in the art will appreciate that the conception upon which this disclosure is based may readily be utilized as a basis for designing other materials, methods and systems for carrying out the purposes of the disclosed invention.

It is important, therefore, that the object and claims be regarded as including such equivalent constructions and methodology in so far as they do not depart from the spirit and scope of the present invention.

Further objectives of the invention will be brought out in the following part of the specifications where detailed prescription is for the purpose of fully disclosing the invention without placing limitations thereon.

SUMMARY OF THE INVENTION

The beach towel herein described and disclosed has one hole in the middle and one hole in any of the edges or perimeter where a handle of an umbrella can be planted in either of the two holes. The hole is three inches in diameter. The area of the round beach towel is eight feet in diameter, the rectangular beach towel has five feet in width and eight feet in length while the square beach towel has eight feet in length and eight feet in width. The cloth material is terry.

The shaded area of the towel is maximized when used with an umbrella. So much comfort is given to users.

Accordingly, it is the object of this invention claimed herein to provide a round, rectangular or square beach towel with a hole in the middle and a hole in any of the edges or perimeter where the handle of an umbrella can be plan

BRIEF DESCRIPTION OF THE DRAWING FIGURES

The accompanying drawings which are incorporated in and form part of this specification to illustrate embodiments of the disclosed invention and together with the description, serve to explain the principle of the invention.

DETAILED DESCRIPTION OF PREFERRED EMBODIMENTS OF THE DISCLOSED INVENTION

Figure 1:
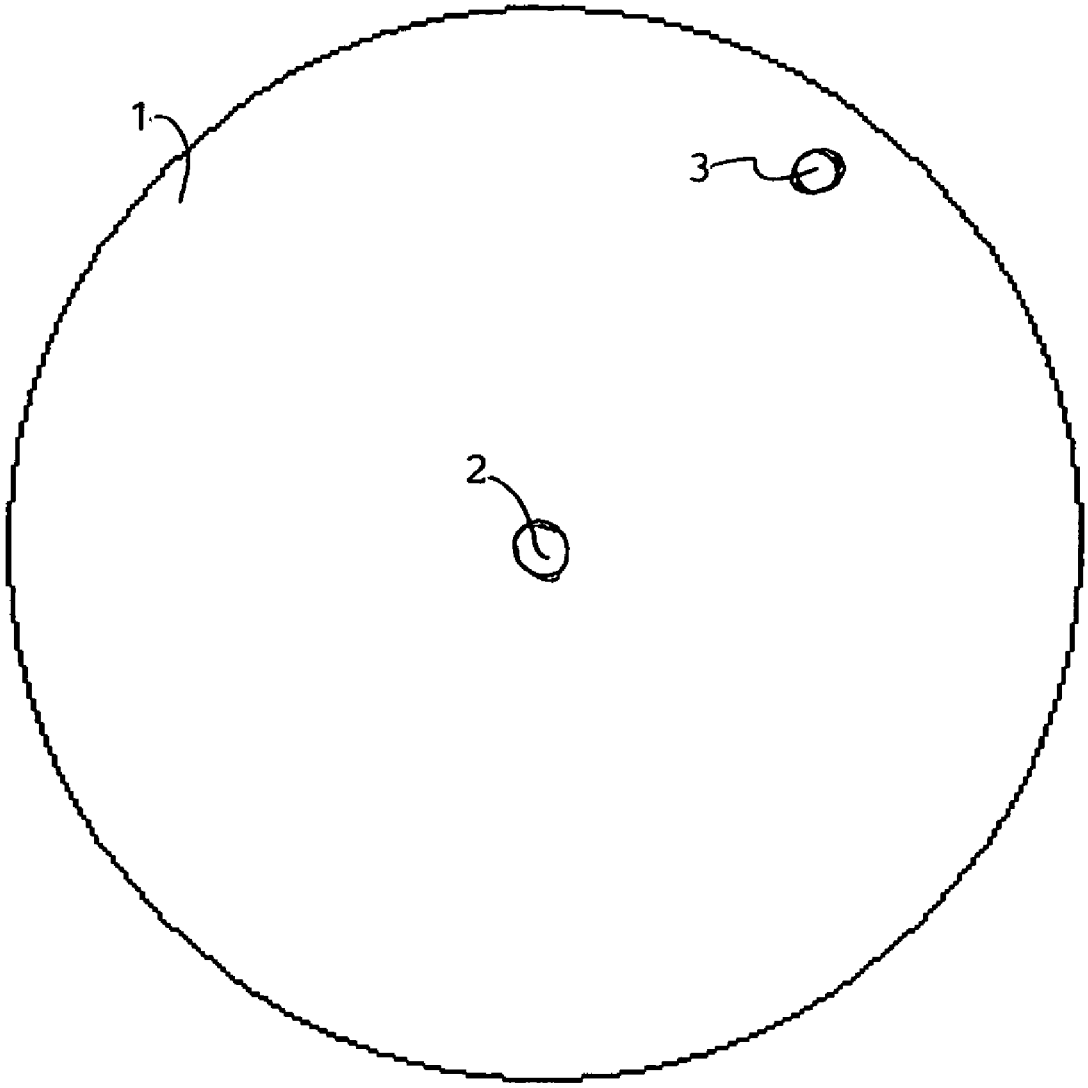
FIG. 1 is a plan view of the round beach towel.
Figure 2:
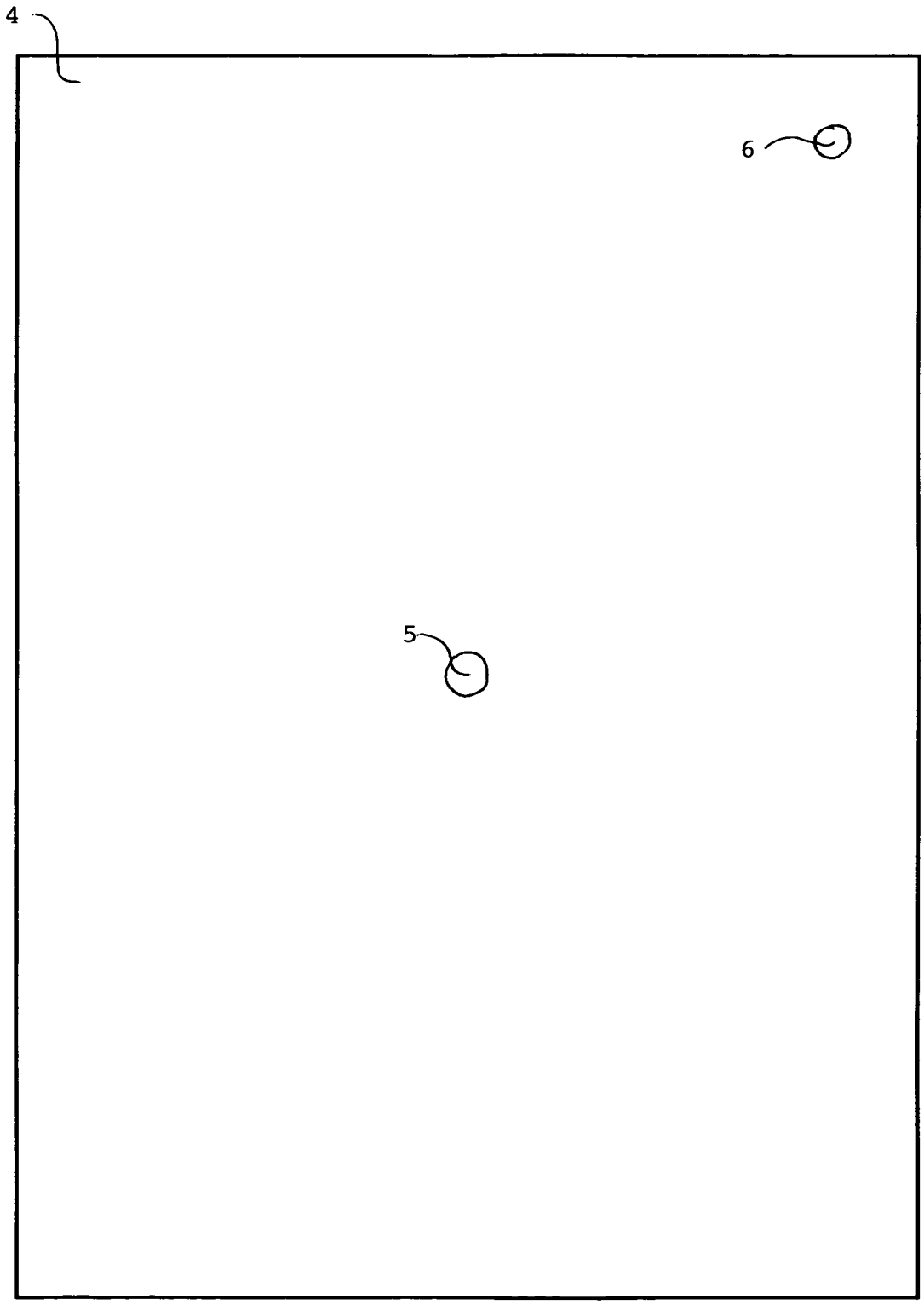
FIG. 2 is a plan view of the rectangular beach twoel.
Figure 3:
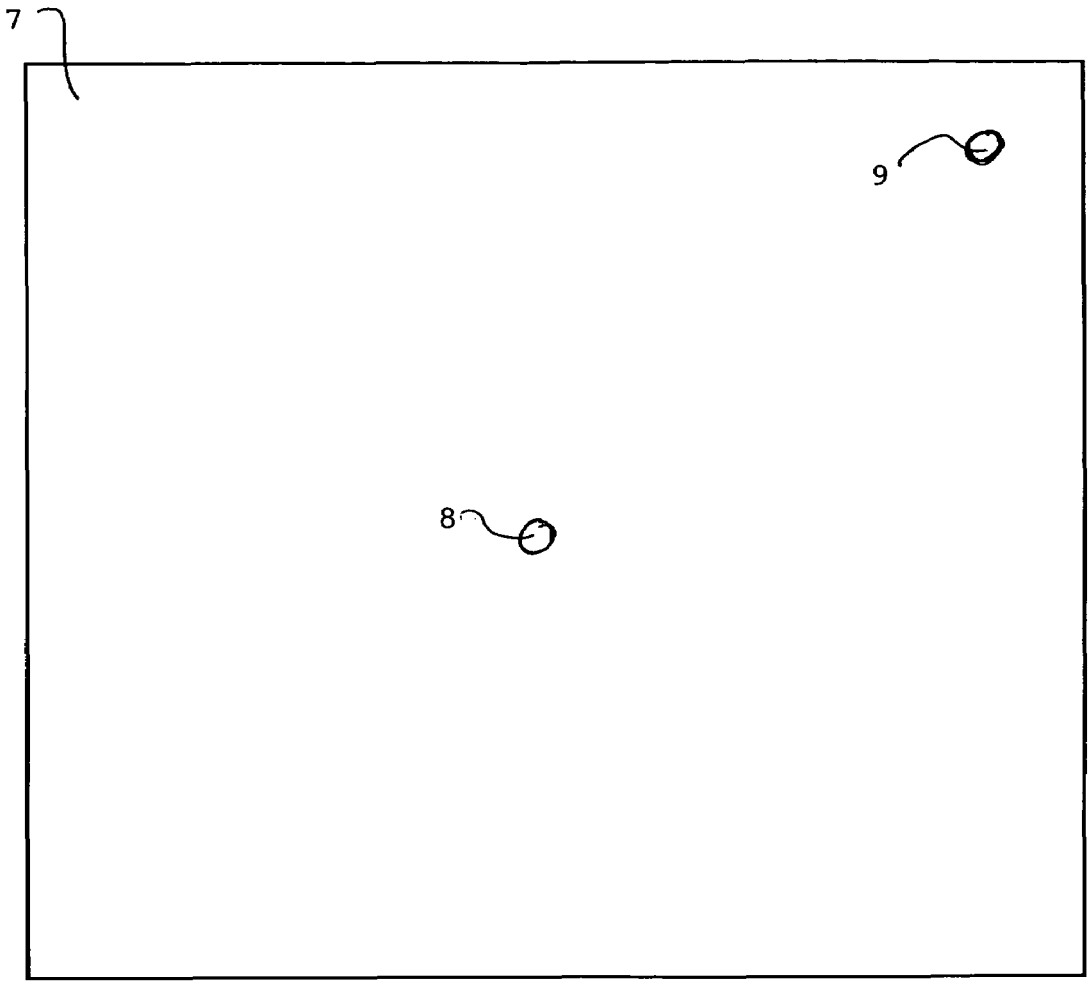
FIG. 3 is a plan view of the square beach towel.
Figure 4:
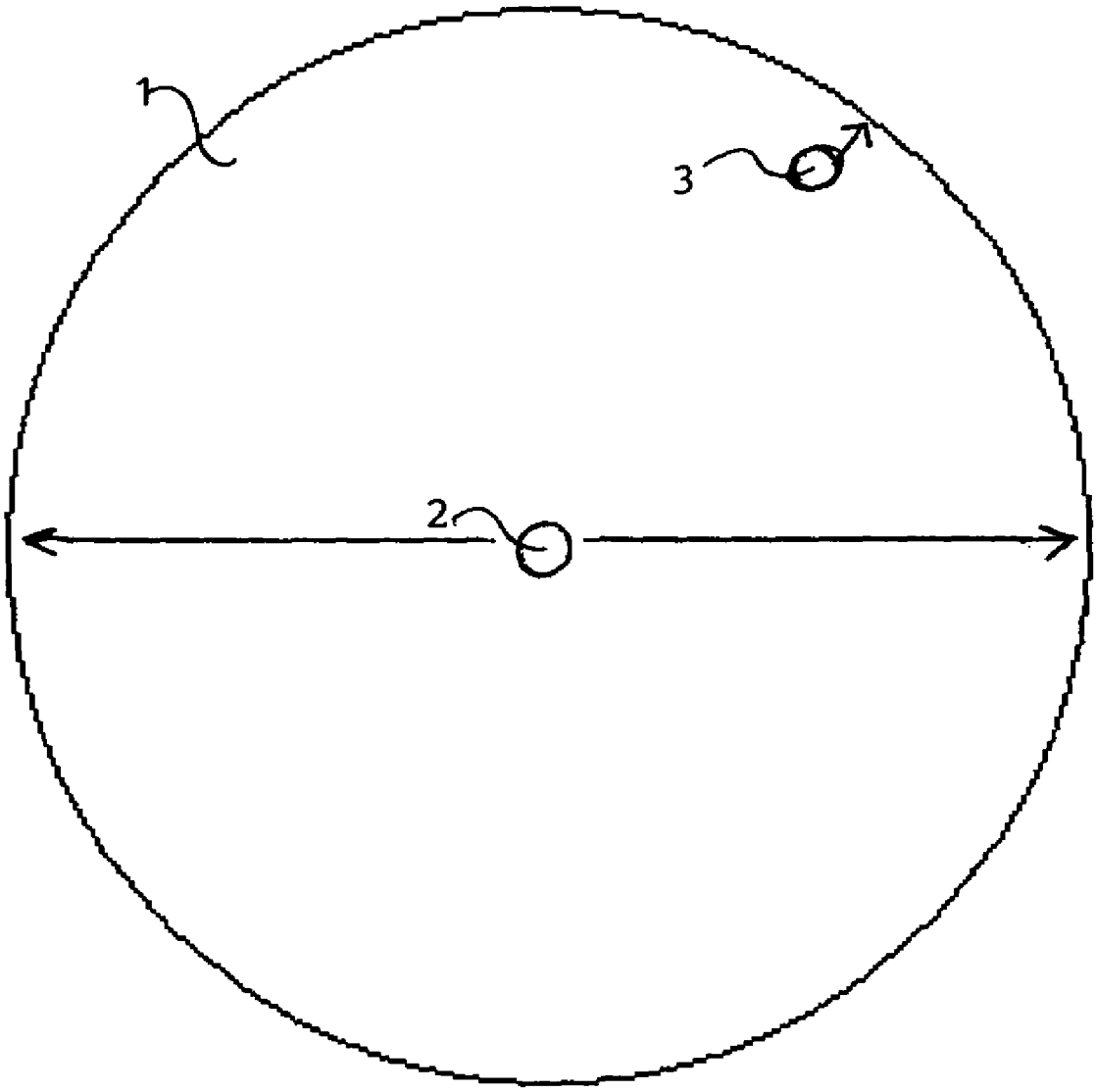
FIG. 4 illustrates the round beach towel with the size in diameter of the towel, one hole in the middle and the distance of the second hole along the perimter of the towel.
Figure 5:
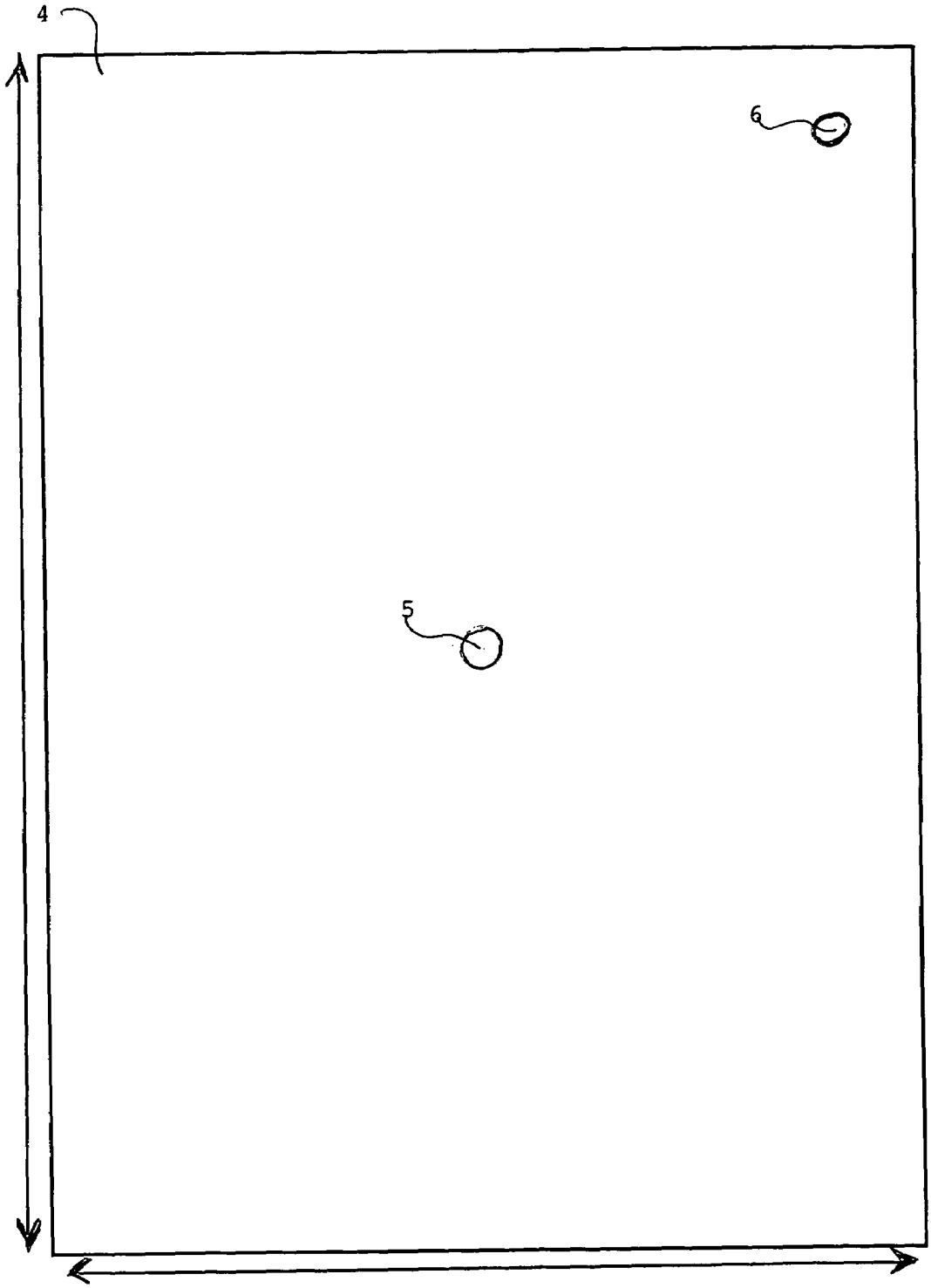
FIG. 5 shows the rectangular beach towel with the sizes in diameter of the two holes, the length and the width and the distance of the second hole along the edge of the towel.
Figure 6:
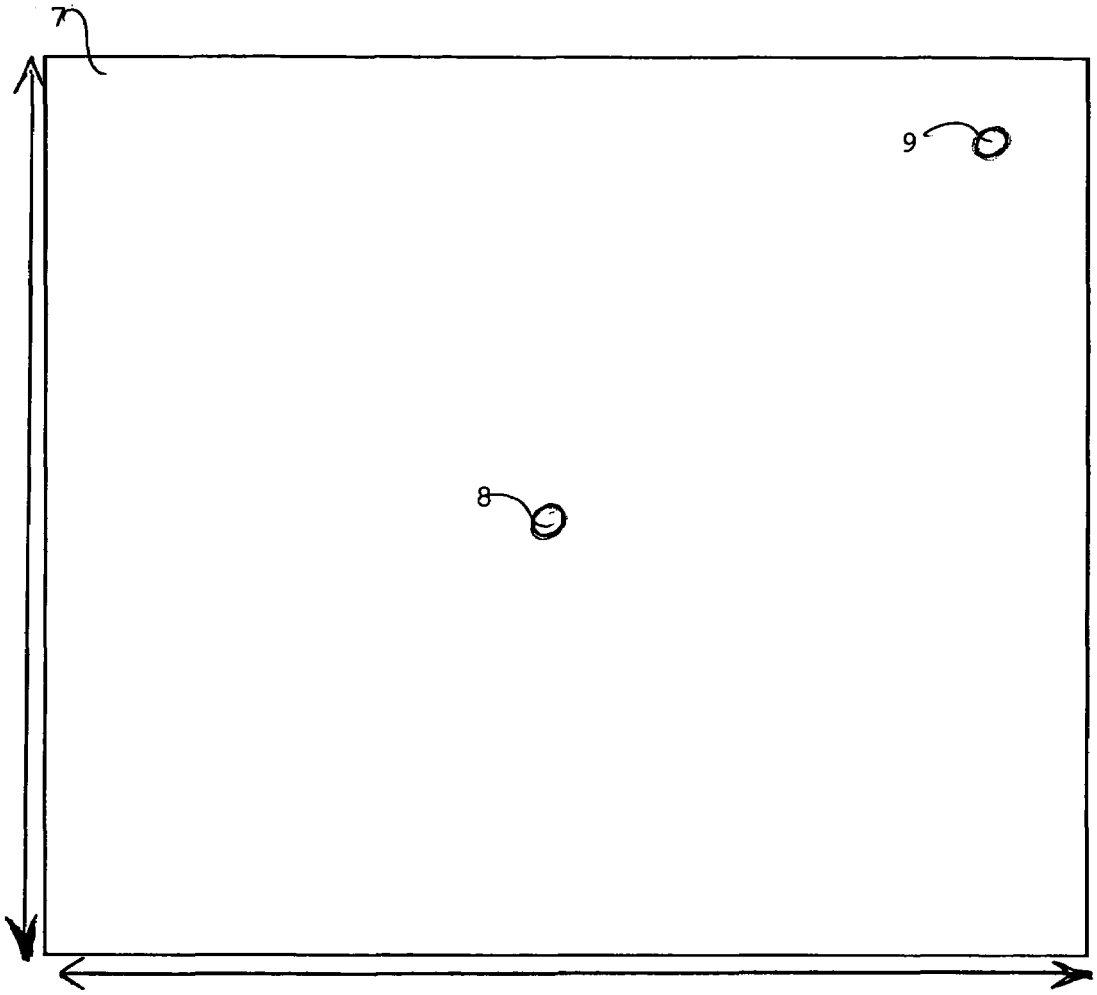
FIG. 6 depicts the square beach towel with the size in diameter of the two holes, the length and width of the towel, and the distance of the second hole along the edge of the towel.

With reference to the drawings shown in FIGS. 1–6, the sizes of the towel are shown. FIG. 1 shows round beach towel 1, center hole 2 and off-center hole 3, FIG. 2 shows rectangular beach towel 4, center hole 5 and off-center hole 6, and FIG. 3 shows square beach towel 7, center hole 8 and off-center hole 9. As can be seen in FIG. 4, the round beach towel has eight feet in diameter, its hole in the middle and in any of its perimeter is three inches in diameter and the distance of the second hole is one foot or twelve inches to any of the perimeter; it also shows round beach towel 1, center hole 2 and off-center hole 3. As shown in FIG. 5, the rectangular beach towel has five feet in width and eight feet in length and the hole in the middle and the hole in any along the edges is 3 inches in diameter while the distance of the second hole is one foot or 12 inches from the edge of the towel; it also shows rectangular beach towel 4, center hole 5, and off-center hole 6. As shown in FIG. 6, the square shaped beach towel has a width of eight feet and eight feet in length with a hole in the middle and in any along the edges with three inches in diameter. The distance of the second hole to any of the edges is one foot or 12 inches; it also shows square beach towel 7, center hole 8 and off-center hole 9.

The center hole provides the spot where the handle of the umbrella is planted. The umbrella provides the shade to the beach towel where the user lies or sits down or stands. The off-center hole is utilized when the sun changes position as the umbrella's handle is removed from the center hole and is planted at the off-center hole. The beach towel is turned correspondingly to be aligned to the umbrella's handle for shade.

As used herein and in the claims, the term "blanket" refers to beach towels, beach blankets, picnic blankets, and any other fabric spreads typically used for sitting or lying upon.

Further, the purpose of the attached abstract is to enable the U.S. Patent and Trademark Office and the general public and especially the practitioners in the art who are not familiar with patent or legal terms or phraseology, to determine quickly from a cursory inspection of the nature and essence of the disclosure of the application. The abstract is neither intended to define the application which is measured by the claims, nor is it intended to be limiting as to the scope of the invention in any way.

The invention claimed is:

1. A blanket for spreading upon the ground outdoors in the sun, the blanket consisting of:

(a) a panel of blanket material;

(b) a center hole defined by the panel for allowing an umbrella handle to project through and be inserted in the earth; and (c) a second hole defined by the panel for allowing an umbrella handle to project through and be inserted in the earth, the distance of the second hole being twelve inches internal from an outer edge of the panel.

* * * * *